US005116485A

United States Patent [19]

Krisa

[11] Patent Number: 5,116,485

[45] Date of Patent: May 26, 1992

[54] APPARATUS AND METHOD FOR RECOVERING DIESEL-QUALITY FUEL FROM PRODUCED CRUDE OIL

[76] Inventor: Thomas E. Krisa, 13802 Trailville Dr., Houston, Tex. 77077

[21] Appl. No.: 644,473

[22] Filed: Jan. 18, 1991

Related U.S. Application Data

[63] Continuation of Ser. No. 226,342, Jul. 26, 1988, abandoned.

[51] Int. Cl.[5] ..... C10G 7/00

[52] U.S. Cl. ..... 208/353; 208/352; 208/355; 208/356; 202/161; 196/134; 203/22; 203/23; 203/87; 203/88

[58] Field of Search ..... 208/352, 353, 355, 356; 202/161; 196/134; 203/22, 23, 87, 88

[56] References Cited

U.S. PATENT DOCUMENTS

| | | | |
|---|---|---|---|
| 3,210,271 | 10/1965 | Byerly et al. | 208/355 |
| 3,320,159 | 5/1967 | Potts | 208/363 |
| 3,321,397 | 5/1967 | Meyers | 208/344 |
| 3,338,825 | 8/1967 | Taggart | 208/350 |
| 3,620,930 | 11/1971 | Tschopp | 208/39 |
| 4,082,654 | 4/1978 | Gewartowski | 208/354 |
| 4,239,618 | 12/1980 | Peeser et al. | 208/255 |
| 4,308,130 | 2/1981 | Bunnon | 208/355 |

FOREIGN PATENT DOCUMENTS

| | | |
|---|---|---|
| 0070926 | 9/1983 | European Pat. Off. . |
| 0681737. | 10/1952 | United Kingdom . |
| 0822682 | 10/1959 | United Kingdom . |
| 1061208 | 3/1967 | United Kingdom . |
| 1294235 | 10/1972 | United Kingdom . |

*Primary Examiner*—Helane Myers

[57] ABSTRACT

An apparatus and process for recovering a diesel-quality fuel from produced crude oil is described. The diesel-quality fuel is produced by flashing the crude feedstock at high temperatures and recovering the diesel quality fuel as a liquid from a refluxing exchanger. Process efficiency is enhanced by heat integration. The process is particularly applicable to remote locations, both onshore and offshore, where conventional fuel supplies are inadequate or not available.

4 Claims, 1 Drawing Sheet

APPARATUS AND METHOD FOR RECOVERING DIESEL-QUALITY FUEL FROM PRODUCED CRUDE OIL

This is a continuation of copending application Ser. No. 07/226,342 filed July 29, 1988.

BACKGROUND OF THE INVENTION

1. Field of the Invention

This invention pertains to novel apparatus, and a method of use, for recovering diesel-quality fuel from produced crude oil.

2. Description of the Prior Art

Refineries around the world have used fractional distillation techniques to isolate and recover certain hydrocarbons or hydrocarbon cuts from crude oil. Such refineries process huge volumes of crude oil through a complex network of piping, distillation columns, hydrocarbon cracking units, etc., to produce hydrocarbon fuel (e.g., diesel, gasoline, etc.) and other products.

Diesel fuel oils, typically referred to as "diesel," are classified as Grade No. 1-D, Grade No. 3-D and Grade No. 4-D depending upon their volatility, flash point, viscosity, pour point, cloud point, ash content, cetane number, and other physical properties. A "diesel-quality fuel" will be a hydrocarbon liquid having similar properties. Each of these fuel oils can be used as fuels for internal combustion engines, although one grade may be better than the others depending upon the engine speed and load on the engine. See, for example, *Kirk-Othmer Encyclopedia of Chemical Technology*, Third Edition, Volume 11, pages 682–689 (1980) for an expanded discussion of diesel fuels.

Grade 2-D diesel fuel is used in many diesel engines in the oil and gas industry to generate energy for turbines and other pieces of equipment. It is also used as fuel for other fired equipment to provide process and utility heat.

Unfortunately, many of these diesel engines are at remote locations (e.g., offshore drilling platforms) where it is difficult and/or costly to supply the diesel fuel for their operation. In such situations, fuel for most remote locations is usually produced or purchased natural gas, when it is available. Alternative fuels are natural gas liquids (NGLs), diesel, and in some instances crude oil. Diesel fuel is typically transported to the location and stored for consumption. The transportation costs are expensive and storage space is sometimes in very short supply (e.g., on offshore drilling or production platforms).

Thus, one of the objects of this invention is to produce a diesel-quality fuel using a system (apparatus) designed to minimize equipment weight and space.

SUMMARY OF THE INVENTION

A novel apparatus and method of use have now been discovered for recovering a diesel-quality fuel from produced crude oil. The diesel-quality fuel is produced by flashing the crude at elevated temperatures and recovering the diesel-quality fuel as a liquid from a refluxing exchanger. The process efficiency is enhanced by heat integration. The apparatus and process are particularly applicable in the oil and gas industry to provide a hydrocarbon fuel to remote locations, both onshore and offshore, where conventional fuel supplies are inadequate, not available, or not economic because of costs associated with purchase prices, transportation, storage and handling, etc. The system can be skid-mounted to facilitate installation and handling.

According to the current invention, a diesel-quality fuel is obtained by heating a crude oil feed (preferably a stabilized crude oil), under pressure (preferably, from atmospheric to about 50 psig) to a temperature at which a diesel-quality fuel and lighter components are separated as a vapor product (gas) from the crude oil feed, thereby leaving a liquid residue of heavier hydrocarbons. The components in the vapor are further separated in a refluxing exchanger into a diesel-quality fuel, which is recovered as a liquid effluent stream, and a vapor stream comprising lighter hydrocarbons. The energy efficiency of this process is enhanced by heat recovery from all effluent streams.

Several advantages of the present invention will also be apparent to the person skilled in the art and responsible for providing fuel in remote, hard to reach areas of oil and gas production; i.e., (a) small size and lower weight, which is critical on offshore platforms; (b) low installation cost, relative to a conventional diesel recovery system with full-scale distillational towers, etc.; (c) a diesel-quality fuel is obtained which has a low ash content, a property that is important if not critical for turbine applications; (d) conventional atmospheric tanking can be used for receiving and storing the diesel-quality fuel; (e) the system has a simple, flexible design that can be easily adapted to accommodate various feed rates of crude oil; and (f) the system/process is very efficient and cost effective for most operations.

BRIEF DESCRIPTION OF THE DRAWING

The system selected for heat recovery from the product streams and potential heat integration of the heat medium(s) and cooling medium(s) is dependent upon product stream specifications and the chemical composition of the crude oil feed for the specific application. As such, the system can be varied to meet the needs of the operator and operation. In FIG. 1, for example, heat exchangers (1, 2, and 3) at the front end of the system are not required, but the presence of at least one heat exchanger is preferred and the presence of two or three heat exchangers is most preferred. In the embodiment shown in FIG. 1, the crude oil feed (line 11) is split and heated as the split streams pass through heat exchangers 1, 2, and 3 by liquid effluent streams from the flash vessel (5) and the diesel accumulator (6) and the gaseous effluent stream taken overhead from the refluxing exchanger (7) through line 17.

Figure 1:
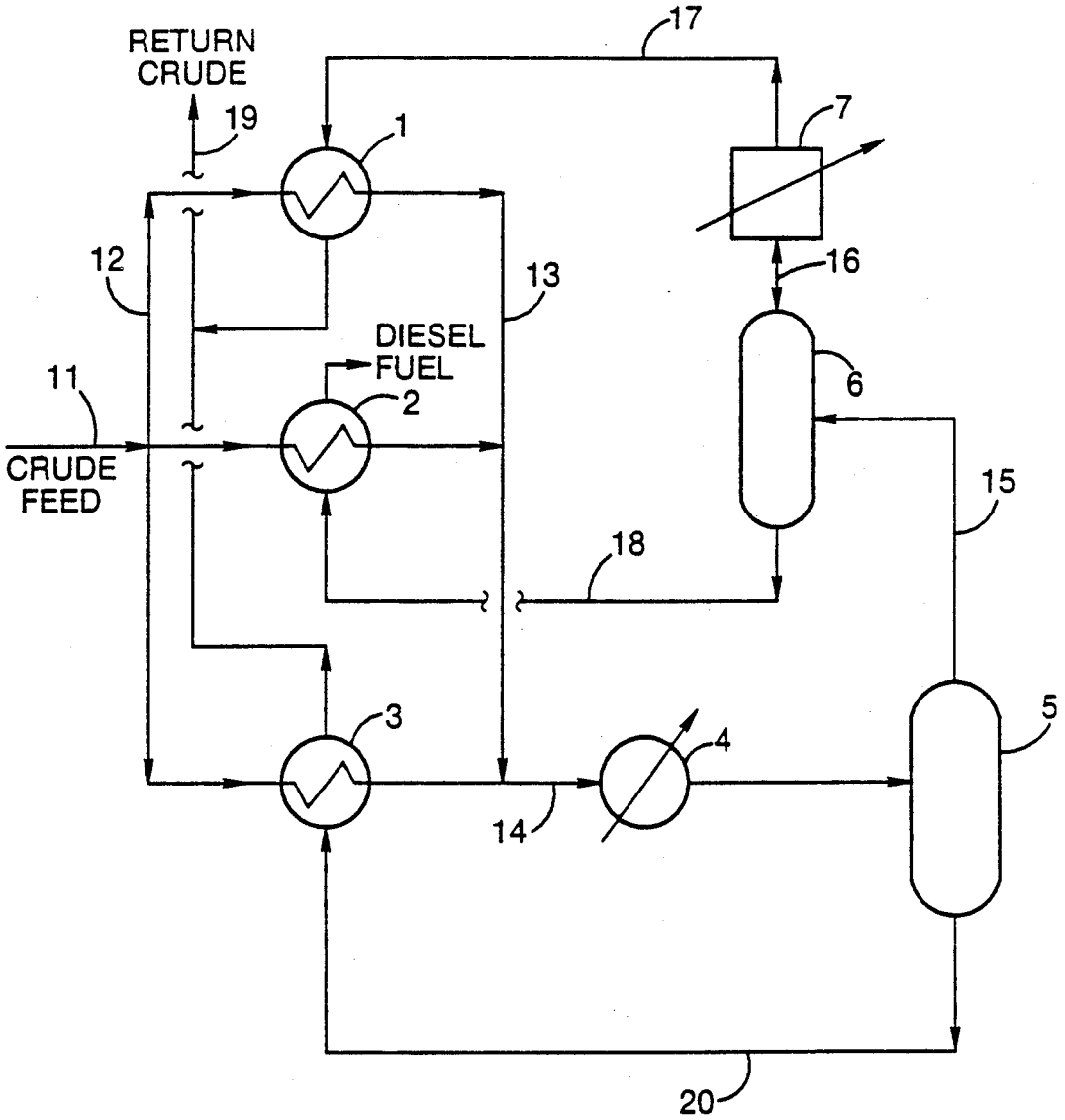
FIG. 1 shows a diagram of the novel system (apparatus) which includes one of several (albeit preferred) possible heat integration configurations.

The split streams of crude oil feed are then recombined in line 13, heated further in heat exchanger 4 and introduced into flash vessel 5. The temperature of the crude oil feed as it enters the flash vessel 5 is sufficiently high to cause the diesel-quality fuel component(s) and lighter hydrocarbons to vaporize and separate from the liquid residue of heavier hydrocarbons at the pressure (e.g., less than 50 psig) in the flash vessel 5. The liquid residue of heavier hydrocarbons is returned to the bulk of crude oil by flow through lines 19 and 20. The vapor effluent taken overhead of the flash vessel 5 flows through line 15 into diesel accumulator 6 which is in fluid communication with refluxing exchanger 7 by line 16. The diesel-quality fuel component of the vapor stream condenses to a liquid in the refluxing exchanger 7, flows as reflux back into diesel accumulator 6, and is withdrawn for storage or consumption through line 18.

The lighter hydrocarbons in the vapor stream are taken overhead from the refluxing exchanger by line 17 and combined with the liquid residue of heavier hydrocarbons flowing through line 19.

The heat exchangers referenced in FIG. 1 are conventional heat exchangers that can be heated or cooled with conventional fluids. The type of heat exchanger chosen is not critical to the invention. A variety of heat exchangers are shown in *Perry's Chemical Engineers' Handbook* by Robert H. Perry and Don Green, Sixth Edition (1984), Section 11 entitled "Heat-Transfer Equipment." Heat exchangers 1, 2, 3 and 4 are preferably, however, of the shell and tube type of heat exchangers, based on current economics. Refluxing exchanger 7 can be a fractionating condenser as described by Lucadamo, et al., *Gas Separation & Purification*, 1987 Volume 1 December, or, preferably a plate-fin type of heat exchange. The flash vessel 5 and diesel accumulator and are also conventional and sized to meet flow requirements.

The crude oil feed is under low pressure (e.g., less than about 50 psig) and hot (e.g., about 500°-600° F.) when it enters the flash vessel 5. Thus, there is a substantial amount of energy in the system that can be recovered from the liquid effluent of heavier hydrocarbons in line 20 (temperature of about 450°-600° F.), from the liquid effluent of diesel in line 18 (temperature about 175°-250° F.), and from the gaseous effluent in line 17 (temperatures about 175°-250° F.). Heat exchangers at the front end of the process (e.g., heat exchanges, 1, 2 and 3) are very useful in recovering heat from the effluent streams and thereby enhancing the economics of the process. Other configurations and embodiments of the inventions will be apparent to those skilled in the art.

What is claimed is:

1. A process for separating diesel-quality fuel from a crude oil feedstream and returning a liquid residue stream of heavier hydrocarbons and a lighter hydrocarbon stream to a stream of crude oil comprising the steps of:

(a) flashing in a flash vessel a crude oil feedstream under conditions effective for separating a vapor product comprising diesel quality fuel and lighter hydrocarbon components from a liquid residue of heavier hydrocarbons, and producing a vapor stream comprising diesel-quality fuel and lighter hydrocarbon components and a liquid residue stream of heavier hydrocarbons;

(b) passing the vapor stream through a diesel-quality fuel accumulation vessel thence into a refluxing exchanger;

(c) condensing the diesel-quality fuel component of the vapor stream to a liquid in the refluxing exchanger and removing overhead from the refluxing exchanger a lighter hydrocarbon stream comprising the lighter hydrocarbon components of the vapor stream;

(d) removing the liquid stream comprising diesel-quality fuel component from the refluxing exchanger and flowing the liquid stream back into the diesel-quality fuel accumulation vessel and accumulating diesel-quality fuel therein;

(e) removing from the flash vessel the liquid residue stream of heavier hydrocarbons and combining said liquid residue stream and said lighter hydrocarbon stream removed from the refluxing exchanger with a crude oil stream; and (f) withdrawing a diesel-quality fuel stream from the diesel-quality of fuel accumulation vessel.

2. The process defined by claim 1 wherein the crude oil feedstream is heated in one or more heat exchangers which are in heat exchange with one or more of:

(i) said liquid residue stream of heavier hydrocarbons, (ii) said diesel-quality fuel stream, and (iii) said lighter hydrocarbon stream removed from the refluxing exchanger.

3. Apparatus for separating diesel-quality fuel from a crude oil feedstream and for returning a liquid residue stream of heavier hydrocarbons and a lighter hydrocarbon stream to a stream of crude oil comprising the steps of:

(a) means including a flash vessel for flashing a crude oil feedstream under conditions effective for separating a vapor product comprising diesel-quality fuel and lighter hydrocarbon components from a liquid residue of heavier hydrocarbons, and for producing a vapor stream comprising diesel-quality fuel and lighter hydrocarbons and a liquid residue stream of heavier hydrocarbons;

(b) means for passing the vapor steam through a diesel-quality fuel accumulation vessel thence into a refluxing exchanger, the refluxing exchanger effective for condensing the diesel-quality fuel component of the vapor stream to a liquid and further comprising means for removing the lighter hydrocarbon components of the vapor stream overhead from the refluxing exchanger as a lighter, hydrocarbon stream;

(c) means for flowing the diesel-quality fuel component condensed to a liquid in the refluxing exchanger back into said diesel-quality fuel accumulation vessel and for accumulating the diesel-quality fuel therein;

(d) means for removing from the flash vessel the liquid residue stream of heavier hydrocarbons and for combining said liquid residue stream and said lighter hydrocarbon stream removed from the refluxing exchanger with a crude oil stream; and (e) means for withdrawing a diesel-quality fuel stream from the diesel-quality fuel accumulation vessel.

4. The apparatus defined in claim 3 wherein the means for providing comprises one or more heat exchangers in heat exchange contact with one or more of:

(i) said liquid residue stream of heavier hydrocarbons, (ii) said diesel-quality fuel stream, and (iii) said lighter hydrocarbon stream removed from the refluxing exchanger.

* * * * *